United States Patent [19]

Nakagawa et al.

[11] 4,068,145

[45] Jan. 10, 1978

[54] INSULATED ELASTIC SUPPORT AND CLAMPING MEANS FOR RESISTANCE HEATERS AND EMITTER TIP OF ELECTRON GUN

[75] Inventors: Seiichi Nakagawa; Youichi Shibuki, both of Akishima, Japan

[73] Assignee: Nihon Denshi Kabushiki Kaisha, Tokyo, Japan

[21] Appl. No.: 752,235

[22] Filed: Dec. 20, 1976

[30] Foreign Application Priority Data

Dec. 24, 1975 Japan ..... 50-154355

[51] Int. Cl.[2] ..... H01J 1/16; H01J 19/08

[52] U.S. Cl. ..... 313/237; 313/311; 313/336; 313/341

[58] Field of Search ..... 313/341, 336, 237

[56] References Cited

U.S. PATENT DOCUMENTS

| | | | |
|---|---|---|---|
| 3,478,244 | 11/1969 | Meyer et al. | 313/237 |
| 3,532,923 | 10/1970 | Vogel | 313/341 |

*Primary Examiner*—Alfred E. Smith
*Assistant Examiner*—Charles F. Roberts
*Attorney, Agent, or Firm*—Webb, Burden, Robinson & Webb

[57] ABSTRACT

An electron gun having a thermionic emitter held by boron carbide heating members or the like, supported by electroconductive members which have additional elastic positioning members arranged to nullify the emitter shift and other effects caused by heat distortion.

5 Claims, 4 Drawing Figures

PRIOR ART

INSULATED ELASTIC SUPPORT AND CLAMPING MEANS FOR RESISTANCE HEATERS AND EMITTER TIP OF ELECTRON GUN

As disclosed in the priot art and specifically in U.S. Pat. No. 3,532,923, lanthanum hexaboride and pyrolytic graphite are particularly desirable materials for electron emitters and emitter support respectively. However, the supporting structure, being subjected to heat, undergoes extensive plastic deformation, a fact which causes the emitter to become displaced and also causes mechanical contact aberrations. As a result, the electron beam source is shifted and the electron beam intensity fluctuates.

It is an object of this invention to provide an electron gun not subject to the above short-comings near the emitter tip.

Briefly according to this invention, there is provided a thermal emission electron gun of the type having a thermionic emitter tip held by electrical resistance heating elements and positioned by apparatus supporting the tip and heating elements. The improvements according to this invention are elastic supports comprised of a material which retains its resiliency at elevated temperatures. One end of the elastic supports is fixed to the supporting apparatus at a location spaced from the emitter tip. Insulating elements are wedged between the unfixed ends of the elastic support and the supporting apparatus for applying pressure to clamps, the tip and heating elements.

This invention will now be described with reference to the drawings, in which.

Figure 1:
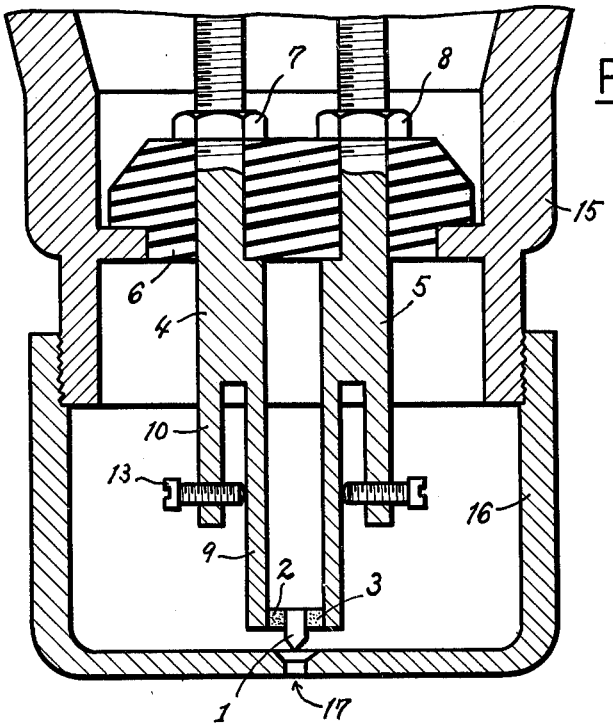
FIG. 1 illustrates a prior art structure utilizing a lanthanum hexaboride emitter.

Referring now to FIG. 1, which illustrates the prior art a lanthanum hexaboride emitter (cathode) 1 is held by pyrolytic graphite members 2 and 3 which also function as heating elements. The pyrolytic graphite members 2 and 3 are supported by electroconductive supporting members 4 and 5 which pass through an insulating holder 6 and are fixed thereto by nuts 7 and 8. The insulating holder 6 is secured to a gun stage 15. A Wehnelt electrode 16 with an opening 17, is threaded onto the gun stage 15. The lower part of the electroconductive supporting members 4 and 5 are slotted to provide inner extensions 9 and 11 and outer extensions 10 and 12. Screws 13 and 14 threadably engage outer extensions 10 and 12 and bear upon inner extensions 9 and 11. By turning in the screws 13 and 14, the resilience of the inner extensions 9 and 11, which directly support the graphite members 2 and 3, may be varied. As a result, the position of the emitter 1 and the Wehnelt opening 17 may be altered.

The output terminals of a electrical heating current supply (not shown) are connected to the supporting members 4 and 5 in order to heat the graphite members 2 and 3 and the emitter 1. The graphite members 2 and 3 are laminated and the laminations lie perpendicular to the directional flow of the heating current. By orientating the laminations thus, the electrical resistance and the ratio of the specific resistance and heat conductive of the graphite members 2 and 3 are high.

In the prior art electron gun described above, the graphite members are heated by the heating current so that the heated emitter 1 emits electrons. At the same time, however, the inner extensions 9 and 11 reach about 1500°~1700° K, the outer extensions 10 and 12 reach about 500° K, and when the graphite members reach 2000°K, the emitter reaches 1900° K. Accordingly, the inner extension 9 and 11 become plastically deformed because they are subjected to pressure from screws 13 and 14 and heat from the graphite members 2 and 3. This deformation of the inner members 9 and 11, in turn, results in insufficient mechanical contact between the emitter 1 and said graphite members 2 and 3 and said inner members 9 and 11 and thereby causes the heating current intensity to fluctuate in accordance with electrical resistance at each mechanical contact position. Moreover, the temperature of the emitter 1 fluctuates, thereby causing the thermal emission current to fluctuate. Also, the emitter 1 shifts. In other words, in the prior art electron gun, the electron beam intensity and the position of its electron beam source is often difficult to stabilize.

Figure 2:
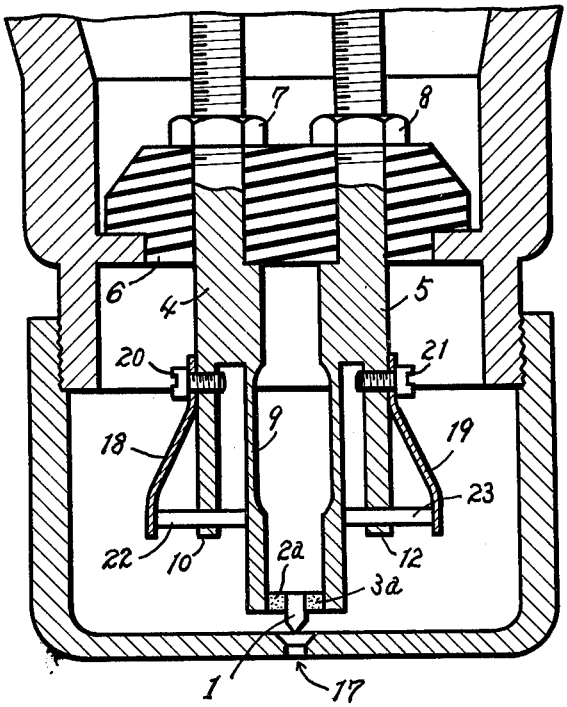
FIG. 2 illustrates one embodiment of the subject invention.

FIG. 2 illustrates one embodiment of this invention in which elastic strip members or elastic belt members 18 and 19 are made of a material which retains its elasticity over a wide range of temperature, for example 273° ~ 1500° K, and has a low gradient of lineality within the elastic boundary delineated in a characteristic stress-strain curve. Preferrably, the elastic members 18 and 19 are made of molybdenum (Mo) or an alloy of molybdenum and titanium (Mo + 0.5 Ti). One end of each of said elastic members 18 and 19 is fixed to supporting members 4 and 5 by screws 20 and 21 at point or position where the temperature increase due to conducted heat from the heating members **2*a* and 3*a* is low. The other end of each of said members 18 and 19 is in pressure contact with the protruding ends of insulators 22 and 23, which are movably mounted on and pass through supporting members 10 and 12 respectively. The other ends of insulators 22 and 23 are in contact with supporting members 9 and 11 so that the resilience of the elastic members 18 and 19 causes said supporting members 9 and 11 to clamp the heating members 2*a* and 3*a* and the emitter 1**.

In this embodiment, two heating members **2*a* and 3*a* are made of boron carbide ($B_4C$), which has higher melting temperature (about 3000° K) than that (about 2200° K) of pyrolytic graphite. Heat generated by the heating members 2*a* and 3*a* increases the temperature of emitter 1 and also that of supporting members 9 and 11. For example, when boron carbide members 2*a* and 3*a* reach 2000° K, the supporting members 9 and 11 reach 1500° ~ 1700° K approximately. As a result of this temperature increase, said supporting members 9 and 11 expand outwardly from the center of the electron gun and the elastic members 18 and 19 are subjected to stress through insulating members 22 and 23. In this case, since said elastic members 18 and 19 are fixed to supporting members 4 and 5 at point or position where the temperature increase due to conducted heat from the heating members 2*a* and 3*a* is low, they retain their resiliency. The deformation of the electroconducting extensions 9 and 11, due to heat expansion, is absorbed by the elastic members 18 and 19**, as a result. The pressure of the inner extensions on the heating members is not decreased and, hence, the electrical resistance at each mechanical contact remains substantially stable and the emitter remains stationary.

Figure 3:
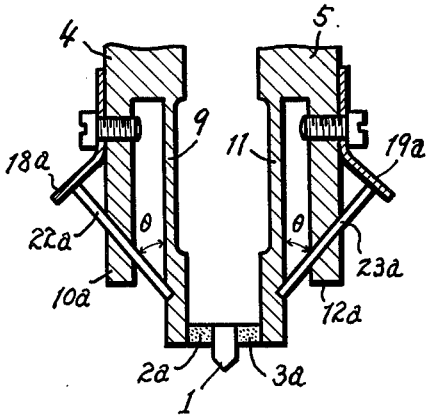
FIGS. 3 and 4 illustrate the essential parts of alternate embodiments of the subject invention.

FIG. 3 shows the essential parts of another embodiment according to this invention. In this embodiment, the insulators 22*a* and 23*a* are arranged so as to pass through supporting members 10*a* and 12*a* obliquely, thus forming an acute angle $\theta$ between the vertical and inclined surface planes. By so doing, the stress force F to which inner extensions 9 and 11 are subjected, is reduced to F sin $\theta$ which is, in turn, absorbed by elastic members 18*a* and 19*a*.

Figure 4:
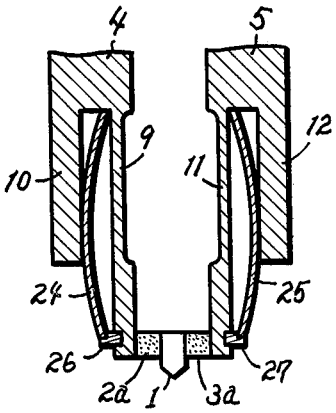

FIG. 4 shows the essential part of yet another embodiment according to this invention in which the elastic members 24 and 25 are arranged across the slotted portion of the supporting members 4 and 5. One end of each of said elastic members 24 and 25 is respectively secured by insulating stoppers 26 and 27, and the other end of each of said elastic members 24 and 25 is wedged as shown in the figure so as to make a bow the apex of which is in contact with the supporting members 10 and 12. Accordingly, the stress force F of the supporting members 9 and 11 is absorbed by the elastic members 24 and 25 as in the case of the other embodiments.

Having thus described my invention in detail and with the particularity required by the Patent Laws, what is desired protected by Letters Patent is set forth in the following claims:

1. A thermal emission type electron gun comprising:

a. an emitter tip (1) being a material capable of electron emission when heated;

b. electrical resistance means (2*a*,3*a*) abutting said emitter tip for heating said emitter tip;

c. means for clamping said heating means (9,11) against said emitter tip and supporting said heating means and tip within the gun; and, d. elastic support means for pressing said clamping means against the heating means and emitter tip comprising elastic biasing means (18, 19) fixed to the clamping means at a location spaced from the emitter tip where the temperature of the clamping means is substantially lower than near the tip and an insulating means (22,23) wedged between the elastic biasing means and the clamping means applying pressure to the clamping means near the emitter tip whereby heat expansion of the clamping means is absorbed by the elastic biasing means.

2. A thermal emission type electron gun as defined in claim 1, wherein said emitter tip is made of lanthanum hexaboride.

3. A thermal emission type electron gun as defined in claim 1, therein said heating means is made of pyrolytic graphite.

4. A thermal emission type electron gun as defined in claim 1, wherein said heating means is made of boron carbide.

5. A thermal emission type electron gun as defined in claim 1, wherein said means for clamping comprise inner extensions (9,11) and outer extensions (11,12), said inner extensions holding said means for heating and said outer extensions guiding the insulating means wedge between the biasing means and outer extensions.

* * * * *